US010632759B2

(12) United States Patent
Honda

(10) Patent No.: US 10,632,759 B2
(45) Date of Patent: Apr. 28, 2020

(54) PRINTING CONTROL APPARATUS, PRINTING CONTROL SYSTEM, AND PRINTING CONTROL METHOD

(71) Applicant: SEIKO EPSON CORPORATION, Tokyo (JP)

(72) Inventor: Kenichi Honda, Kitaazumi-gun (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/219,477

(22) Filed: Dec. 13, 2018

(65) Prior Publication Data

US 2019/0184712 A1 Jun. 20, 2019

(30) Foreign Application Priority Data

Dec. 18, 2017 (JP) ..... 2017-241518

(51) Int. Cl.

| | |
|---|---|
| ***B41J 2/205*** | (2006.01) |
| ***B41J 29/393*** | (2006.01) |
| ***B41J 2/21*** | (2006.01) |
| *B41J 2/135* | (2006.01) |
| *B41J 2/045* | (2006.01) |

(52) U.S. Cl.

CPC ..... *B41J 2/2056* (2013.01); *B41J 2/2054* (2013.01); *B41J 2/2132* (2013.01); *B41J 29/393* (2013.01); *B41J 2/04508* (2013.01); *B41J 2/135* (2013.01)

(58) Field of Classification Search

CPC ..... B41J 2/2056; B41J 2/2054; B41J 2/2132; B41J 29/393; B41J 2/135; B41J 2/362; B41J 2/04508; B41J 2/2142

See application file for complete search history.

(56) References Cited

U.S. PATENT DOCUMENTS 8,403,445 B2 * 3/2013 Iwasaki ..... B41J 2/205 347/14
2013/0293611 A1 * 11/2013 Ueshima ..... B41J 2/125 347/12

FOREIGN PATENT DOCUMENTS

JP 2009-226801 A 10/2009

* cited by examiner

*Primary Examiner* — Thinh H Nguyen
(74) *Attorney, Agent, or Firm* — Foley & Lardner LLP

(57) ABSTRACT

A printing control apparatus configured to control a printing apparatus including an acquisition unit configured to acquire discharge characteristic information including a characteristic of discharging ink for each of nozzles, a correction amount calculation unit configured to calculate a correction amount for correcting an amount of the ink discharged onto a printing medium based on the discharge characteristic information for each of printing modes having mutually different relative movement amounts of the sub scanning movements, and a printing data generation unit configured to generate printing data for executing printing in accordance with the printing mode based on the correction amount.

6 Claims, 14 Drawing Sheets

92

| PRE-CORRECTION | 0 | 1 | 2 | ····· | 200 | ····· | 254 | 255 |
|---|---|---|---|---|---|---|---|---|
| NOZZLE 1 | 0 | 1 | 2 | ····· | 190 | ····· | 244 | 245 |
| NOZZLE 2 | 0 | 1 | 2 | ····· | 185 | ····· | 239 | 240 |
| NOZZLE 3 | 0 | 1 | 2 | ····· | 200 | ····· | 254 | 255 |
| · | · | · | · | · | · | · | · | · |
| · | · | · | · | · | · | · | · | · |
| · | · | · | · | · | · | · | · | · |
| NOZZLE n | 0 | 1 | 2 | ····· | 190 | ····· | 244 | 245 |
| NOZZLE n + 1 | 0 | 1 | 2 | ····· | 195 | ····· | 254 | 255 |
| · | · | · | · | · | · | · | · | · |

Fig. 5

PRINTING CONTROL APPARATUS, PRINTING CONTROL SYSTEM, AND PRINTING CONTROL METHOD

BACKGROUND

1. Technical Field

The present invention relates to a printing control apparatus configured to control a printing apparatus that performs printing by discharging ink onto a printing medium, a printing system including the printing apparatus and the printing control apparatus, and a printing control method for controlling the printing apparatus.

2. Related Art

A printing apparatus such as an ink jet printer includes a nozzle that discharges liquid (ink), and forms (prints) a printed image by discharging the liquid onto a printing medium based on printing data received from an external apparatus (printing control apparatus) such as a computer. Here, the printing data is acquired by performing image processing such as halftone processing on image data serving as a basis of the printed image. Note that, the halftone processing is a process of converting a tone value before conversion of the image data into a tone value after conversion that is a tone value corresponding to dots formed on the printing medium by the printing apparatus (so-called binarization processing).

Meanwhile, the sizes of the dots formed on the printing medium may vary due to variations in processing accuracy of the nozzles (for example, nozzles with different diameters are manufactured). Further, due to the variations in processing accuracy of the nozzles, forming positions of the dots on the printing medium may vary. In a case where the variations in the size of the dots or the variations in the forming positions of the dots occur, stripe-like density unevenness (banding) occurs in the printed image.

Therefore, a method such as BRS correction processing has been proposed as one technique for suppressing such density unevenness and improving image quality of a printed image. The BRS correction processing is a processing operation of correcting an ink discharge amount (density tone value), which measures the generated density unevenness and corrects the ink amount to be discharged based on the measured data to cancel the density unevenness. The BRS correction processing is described in, for example, JP-A-2009-226801.

Specifically, in the BRS correction processing, first, a dedicated pattern for measuring the density unevenness is printed before shipment of a manufactured printing apparatus, and a printing result (density unevenness) is measured with a scanner. Next, based on the measurement result, the correction amount of the ink amount is determined to cancel the generated density unevenness, and a BRS correction table in which the ink amount (density tone value) before the correction and the ink amount after the correction are associated is created for each of the nozzles, and the created BRS correction table is stored and held in a memory included in the printing apparatus. Upon printing, the printing control apparatus that generates printing data corrects the dot ratio data (dot generation rate) for determining the density of the printed image with reference to the BRS correction table stored in the printing apparatus. The printing control apparatus generates printing data based on the corrected dot ratio data.

However, in the BRS correction processing as described in JP-A-2009-226801, there is a problem in that the effectiveness of the acquired correction amount is limited to the case where the printing mode is the same as the printing mode in which the dedicated pattern (dedicated printing pattern for measuring density unevenness) used for determining the correction amount is printed. That is, in a serial printer in which printing is performed by repeating a pass movement for discharging ink while causing a printing head including nozzle rows to do main scanning movement and a sub scanning movement for moving the printing medium, in a case where a plurality of print modes (that is, a plurality of print modes for performing printing with different numbers of passes) are prepared for performing printing by the sub scanning movements with different movement amounts, it is necessary to acquire the correction amount for each printing mode. In addition, in a case where a new printing mode is added, accordingly, a corresponding correction amount has to be acquired by printing and measuring a dedicated pattern used by the new printing mode.

SUMMARY

The present invention has been made to address at least some of the above-described problems and can be realized as the following application examples or aspects.

Application Example 1

A printing control apparatus according to the present application example is a printing control apparatus configured to control a printing apparatus including a printing head including a plurality of nozzles configured to discharge ink onto a printing medium, a main scanning unit configured to perform a main scanning movement causing the printing head to relatively move with respect to the printing medium in a main scanning direction, and a sub scanning unit configured to perform a sub scanning movement causing the printing medium to relatively move with respect to the printing head in a sub scanning direction intersecting with the main scanning direction, and the printing apparatus is configured to perform printing on the printing medium by repeating the sub scanning movement and a pass movement for discharging the ink from the nozzles onto the printing medium during the main scanning movement, the printing control apparatus includes an acquisition unit configured to acquire discharge characteristic information including a characteristic of discharging the ink for each the nozzles, a correction amount calculation unit configured to calculate a correction amount for correcting an amount of the ink discharged onto the printing medium based on the discharge characteristic information for each of printing modes having mutually different relative movement amounts of the sub scanning movements, and a printing data generation unit configured to generate printing data for executing printing in accordance with the printing mode based on the correction amount.

The printing apparatus controlled by the printing control apparatus according to the present application example includes a printing head including a plurality of nozzles for discharging ink onto a printing medium, a main scanning unit configured to perform a main scanning movement causing the printing head to relatively move with respect to the printing medium in a main scanning direction, and a sub scanning unit configured to perform a sub scanning movement causing the printing medium to relatively move with respect to the printing head in a sub scanning direction intersecting with the main scanning direction. Further, the printing apparatus is configured to perform printing on the printing medium by repeating the sub scanning movement and a pass movement for discharging the ink from the nozzles onto the printing medium during the main scanning movement.

According to the present application example, the printing control apparatus includes an acquisition unit configured to acquire discharge characteristic information including a characteristic of discharging the ink for each of the nozzles, a correction amount calculation unit configured to calculates a correction amount for correcting an amount of the ink discharged onto the printing medium based on the discharge characteristic information for each of printing modes having mutually different relative movement amounts of the sub scanning movements, and a printing data generation unit configured to generate printing data for executing printing in accordance with the printing mode based on the correction amount. That is, the printing data for causing the printing apparatus to execute printing is generated for each printing mode based on the correction amount calculated based on the discharge characteristic information including the characteristic of discharging the ink for each of the nozzles. That is, according to the printing control apparatus of the present application example, even in a case where the printing modes are different, the correction amount corresponding to the printing mode is calculated based on the discharge characteristic information including the characteristic of discharging the ink for each of the nozzles, thus the printing apparatus can be caused to perform printing in which the correction suitable for each printing mode is performed, without performing measurement (measurement of density unevenness) and the like for acquiring the correction amount for each different printing mode.

Application Example 2

In the printing control apparatus according to the application example described above, the discharge characteristic information includes a characteristic of a discharge amount for discharging the ink for each of the nozzles.

According to the present application example, the discharge characteristic information for calculating the correction amount includes the characteristic of the discharge amount for discharging the ink for each of the nozzles, and thus, in a case where variation occurs in the discharge amount of ink for each of the nozzles, a correction amount that can appropriately correct the variation can be acquired.

Application Example 3

In the printing control apparatus according to the application example described above, the discharge characteristic information includes a characteristic of discharge direction for discharging the ink for each of the nozzles.

According to the present application example, the discharge characteristic information for calculating the correction amount includes the characteristic of the discharge direction for discharging the ink for each of the nozzles, and thus, in a case where variation occurs in the discharge direction of ink for each of the nozzles, a correction amount that can appropriately correct the variation can be acquired.

Application Example 4

In the printing control apparatus according to the application example described above, the correction amount calculation unit calculates a density distribution of the ink discharged onto the printing medium based on the discharge characteristic information and the printing mode, and calculates the correction amount based on the calculated density distribution.

According to the present application example, the correction amount calculation unit calculates the density distribution of the ink discharged onto the printing medium based on the discharge characteristic information and the printing mode, and calculates the correction amount based on the calculated density distribution.

Based on the printing mode, the relationship of landing positions (positions of the dots to be formed) of the discharged ink is known, and the ink density of the image printed on the printing medium can be estimated by the relationship of the positions and the discharge characteristic information including the characteristic of discharging the ink for each of the nozzles.

That is, the distribution of the estimated ink density of the image is a density estimation information of the printed image reflecting the characteristic of discharging the ink for each of the nozzles in each printing mode. Therefore, according to the present application example, an appropriate correction amount can be calculated in accordance with the estimated density of the printed image based on the discharge characteristic information and the printing mode.

Application Example 5

A printing system according to the present application example includes the printing control apparatus according to the application examples (Application Example 1 to 4) described above, and a printing apparatus including a printing head including a plurality of nozzles configured to discharge ink onto a printing medium, a main scanning unit configured to perform a main scanning movement causing the printing head to relatively move with respect to the printing medium in a main scanning direction, and a sub scanning unit configured to perform a sub scanning movement causing the printing medium to relatively move with respect to the printing head in a sub scanning direction intersecting with the main scanning direction, the printing apparatus being configured to perform printing on the printing medium by repeating the sub scanning movement and a pass movement for discharging the ink from the nozzles onto the printing medium during the main scanning movement.

According to the present application example, even in a case where the printing modes are different, the correction amount corresponding to the printing mode is calculated based on the discharge characteristic information including the characteristic of discharging the ink for each of the nozzles, and thus, the printing, in which the correction suitable for each printing mode is performed, can be performed, without performing measurement (measurement of density unevenness) and the like for acquiring the correction amount for each different printing mode.

Application Example 6

A printing control method according to the present application example is a printing control method for controlling a printing apparatus including a printing head including a plurality of nozzles configured to discharge ink onto a printing medium, a main scanning unit configured to perform a main scanning movement causing the printing head to relatively move with respect to the printing medium in a main scanning direction, and a sub scanning unit configured to perform a sub scanning movement causing the printing medium to relatively move with respect to the printing head in a sub scanning direction intersecting with the main scanning direction, and the printing apparatus being configured to perform printing on the printing medium by repeating the sub scanning movement, and a pass movement for discharging the ink from the nozzles onto the printing medium during the main scanning movement, the printing control method including acquiring discharge characteristic information including a characteristic of discharging the ink for each of the nozzles, calculating a correction amount for correcting an amount of the ink discharged onto the printing medium based on the discharge characteristic information for each of printing modes having mutually different relative movement amounts of the sub scanning movements, and generating printing data for executing printing in accordance with the printing mode based on the correction amount.

The printing apparatus controlled by a print control method according to the present application example includes a printing head including a plurality of nozzles configured to discharge ink onto a printing medium, a main scanning unit configured to perform a main scanning movement causing the printing head to relatively move with respect to the printing medium in a main scanning direction, and a sub scanning unit configured to perform a sub scanning movement causing the printing medium to relatively move with respect to the printing head in a sub scanning direction intersecting with the main scanning direction. Further, the printing apparatus is configured to perform printing on the printing medium by repeating the sub scanning movement and a pass movement for discharging the ink from the nozzles onto the printing medium during the main scanning movement.

The printing control method according to the present application example, includes acquiring discharge characteristic information including the characteristic of discharging the ink for each of the nozzles, calculating a correction amount for correcting amount of the ink discharged onto the printing medium based on the discharge characteristic information for each of printing modes having mutually different relative movement amounts of the sub scanning movements, and generating printing data for executing printing in accordance with the printing mode based on the correction amount. That is, the printing data for causing the printing apparatus to execute printing is generated for each printing mode based on the correction amount calculated based on the discharge characteristic information including the characteristic of discharging the ink for each of the nozzles. That is, according to the printing control method for the present application example, even in a case where the printing modes are different, the correction amount corresponding to the printing mode is calculated based on the discharge characteristic information including the characteristic of discharging the ink for each of the nozzles, and thus, the printing, in which the correction suitable for each printing mode is performed, can be performed, without performing measurement (measurement of density unevenness) and the like for acquiring the correction amount for each different printing mode.

BRIEF DESCRIPTION OF THE DRAWINGS

The present invention will be described with reference to the accompanying drawings, wherein like numbers reference like elements.

FIG. 5 is an example of BRS correction table in the related art.

DESCRIPTION OF EXEMPLARY EMBODIMENTS

Figure 1:
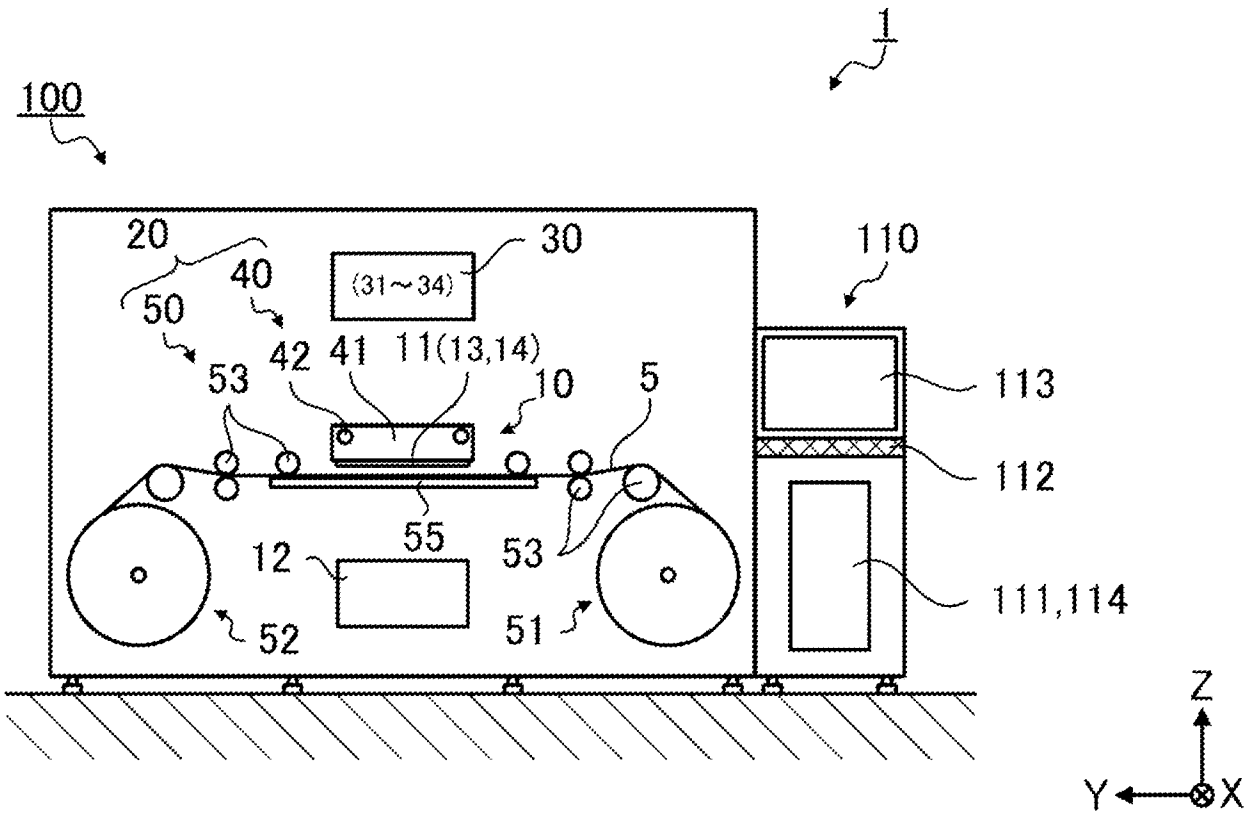
FIG. 1 is a front view illustrating a configuration of a printing system according to Exemplary Embodiment 1.

Exemplary embodiments applied with the present invention will be described with reference to the drawings. The following is one exemplary embodiment of the present invention and is not intended to limit the present invention. Note that, in each of the following drawings, a scale different from the actual scale may be described to make the description to be easily understood. In the coordinates illustrated in the drawings, a Z-axis direction is an up-and-down direction, a +Z direction is an upper direction, an X-axis direction is a front-and-rear direction, a −X direction is a front direction, a Y-axis direction is a left-and-right direction, a +Y direction is a left direction, and an X-Y plane is a horizontal plane.

Exemplary Embodiment 1

Figure 2:
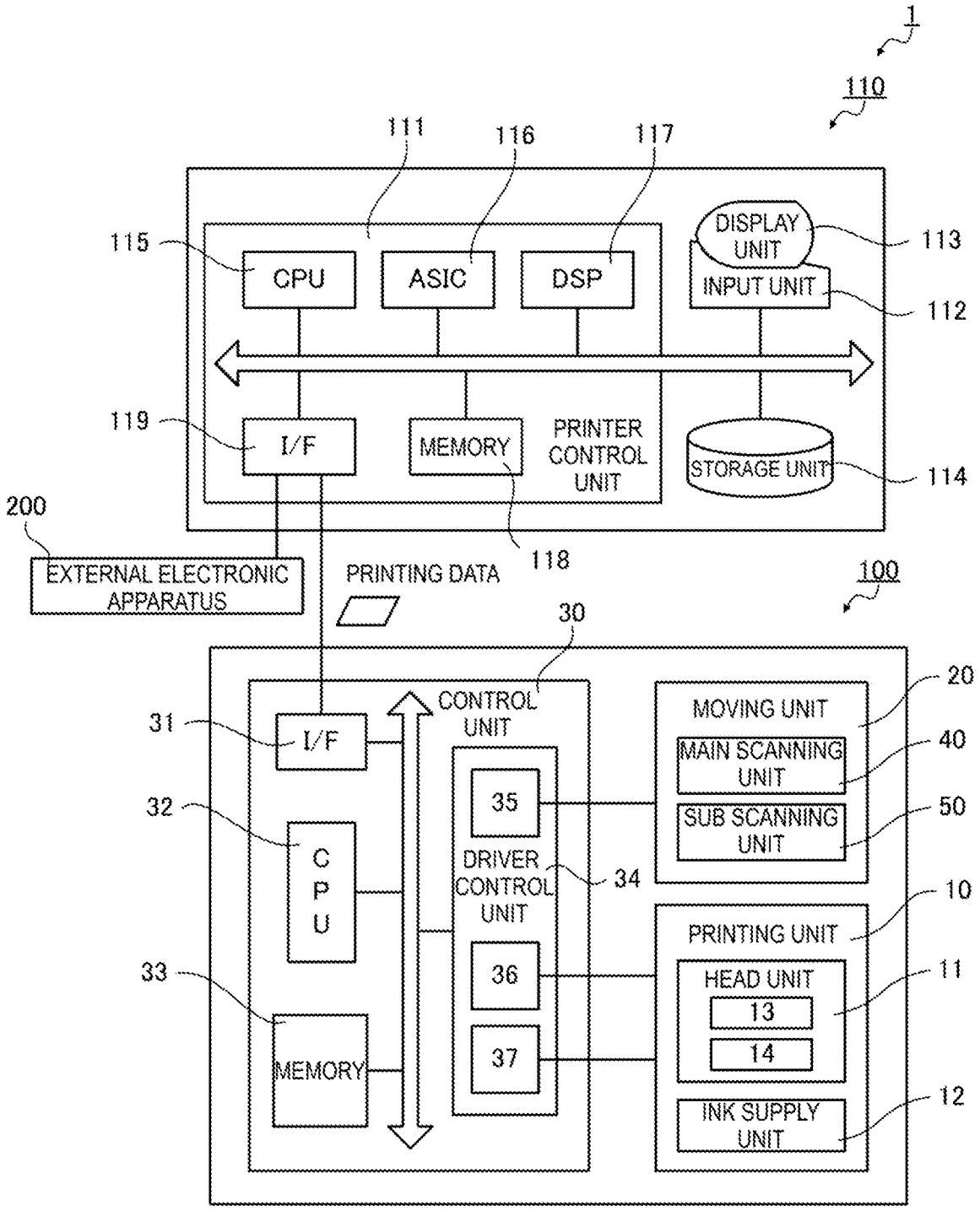
FIG. 2 is a block diagram illustrating the configuration of the printing system according to Exemplary Embodiment 1.

FIG. 1 is a front view illustrating a configuration of a "printing system" (printing system 1) according to Exemplary Embodiment 1, and FIG. 2 is a block diagram of the same.

The printing system 1 is configured with a printer 100 as a "printing apparatus" and a printing control apparatus 110 connected to the printer 100. The printer 100 is an ink jet printer that prints a desired image on long-length roll paper 5 as a "printing medium" supplied in a roll shape, based on printing data received from the printing control apparatus 110.

Basic Configuration of Printing Control Apparatus

The printing control apparatus 110 includes a printer control unit 111, an input unit 112, a display unit 113, a storage unit 114, and the like, and generates printing data for causing the printer 100 to execute printing based on image data corresponding to a printed image. Further, the printing control apparatus performs control of a print job for causing the printer 100 to perform printing, and the like. That is, the printing control apparatus 110 is a printing control apparatus that controls the printer 100, and may be configured by using, for example, a personal computer as a desirable example.

Software on which the printing control apparatus 110 operates includes general image processing application software (hereinafter referred to as an application) that deals with the image data to be printed, and printer driver software (hereinafter, referred to as a printer driver) that generates printing data for controlling printer 100 and causing the printer 100 to execute printing.

The printer control unit 111 includes a Central Processing Unit 115 (CPU 115), an Application Specific Integrated Circuit 116 (ASIC 116), a Digital Signal Processor 117 (DSP 117), a memory 118, a printer interface unit (I/F) 119, and the like, and performs centralized management of the entire printing system 1.

The input unit 112 is an information input unit as a human interface. Specifically, the input unit 112 is, for example, a keyboard, a mouse pointer, and the like.

The display unit 113 is an information display unit (display) as a human interface, and displays information input from the input unit 112, images to be printed on the printer 100, and information related to the print job, and the like, under the control of the printer control unit 111.

The storage unit 114 is a rewritable storage medium such as a hard disk drive (HDD) or a memory card, and stores software on which the printing control apparatus 110 operates (programs operated by the printer control unit 111), an image to be printed, and information related to the print job, and the like.

The ASIC 116 and the DSP 117 constitute an image processing engine for generating printing data under the control of the CPU 115 (printer driver).

The memory 118 is a storage medium that secures an area for storing programs on which the CPU 115 operates, a working area for operation, and the like, and is configured with a storage element such as a RAM and an EEPROM.

The printer interface unit 119 has an interface function of transmitting and receiving data to and from an external electronic apparatus 200 including a network device in addition to an interface function of transmitting and receiving data between the printing control apparatus 110 and the printer 100.

Note that, as the configuration of the printing system 1, it is not necessary to configure the printing control apparatus 110 separately from the printer 100 using a general-purpose personal computer, and may be a configuration, including a microcomputer and the like, in which components having the same function as the printing control apparatus 110 are incorporated in the main body of the printer 100.

Basic Configuration of Printer 100

The printer 100 is configured with a printing unit 10, a moving unit 20, a control unit 30, and the like. The printer 100 that has received the printing data from the printing control apparatus 110 controls the printing unit 10 and the moving unit 20 by the control unit 30 to print (form) an image on the roll paper 5.

The printing data is data for forming image acquired by performing conversion processing on the image data with the application and the printer driver included in the printing control apparatus 110 such that the image data can be printed by the printer 100, and includes commands for controlling the printer 100.

The image data includes, for example, general full-color image information, text information, and the like, acquired by a digital camera and the like.

The printing unit 10 is configured with a head unit 11, an ink supply unit 12, and the like.

The moving unit 20 is configured with a main scanning unit 40, a sub scanning unit 50, and the like. The main scanning unit 40 is configured with a carriage 41, a guide shaft 42, a carriage motor (not illustrated), and the like. The sub scanning unit 50 is configured with a supply portion 51, a storage portion 52, a transport roller 53, a platen 55, and the like.

The head unit 11 includes a printing head 13 including a plurality of nozzles (nozzle rows) for discharging printing ink (hereinafter referred to as ink) as ink droplets, and a head control unit 14. The head unit 11 is mounted on the carriage 41 and reciprocates in a main scanning direction accompanied with the carriage 41 moving in the main scanning direction (the X-axis direction illustrated in FIG. 1). The head unit 11 (print head 13) discharges ink droplets onto the roll paper 5 supported by the platen 55 under the control of the control unit 30 while moving in the main scanning direction, and thus a row of dots (raster line) along the main scanning direction is formed on the roll paper 5.

The ink supply unit 12 includes an ink tank, and an ink supply path (not illustrated) that supplies ink from the ink tank to the print head 13, and the like.

As an ink set configured with the dark ink compositions, the ink set of four colors obtained by adding black (K) to ink set of three colors of cyan (C), magenta (M), and yellow (Y) is used as the ink. Note that, the ink set is not limited to this, and may be, for example, a ink set of eight colors obtained by adding a ink set of light cyan (Lc), light magenta (Lm), light yellow (Ly), and light black (Lk) and the like which are configured with low density ink compositions in which the density of each color material is made low. The ink supply route including the ink tank, the ink supply path, and the nozzle for discharging the same ink is independently provided for each ink.

A piezo method is used as a method for discharging ink droplets (ink jet method). The piezo method is a printing method, in which a pressure corresponding to a printing information signal is applied to the ink stored in a pressure chamber by a piezoelectric element (piezo element), and ink droplets are ejected (discharged) from a nozzle communicating with the pressure chamber.

Note that, the method for discharging ink droplets is not limited to this, and may be another printing method in which ink is ejected in a droplet shape to form a dot group on the printing medium. For example, the method for discharging ink droplets may be a method in which the ink is continuously ejected in a droplet shape from a nozzle at a strong electric field between the nozzle and an acceleration electrode placed in front of the nozzle, and a printing information signal is supplied from a deflection electrode while the ink droplets flying, a method (electrostatic attraction method) for ejecting ink droplets in response to the printing information signal without deflection, a method in which the ink droplet is forcibly ejected by applying pressure to the ink by a small pump and mechanically vibrating the nozzle with a quartz oscillator and the like, and a method (thermal jet method) in which the ink is heated to be foamed by a micro electrode according to the printing information signal and the ink droplet is ejected to perform printing, and the like.

The moving unit 20 (main scanning unit 40, and sub scanning unit 50) causes the roll paper 5 to relatively move with respect to the head unit 11 (print head 13) under the control of the control unit 30.

The guide shaft 42 extends in the main scanning direction and supports the carriage 41 in a slidable state, and, the carriage motor serves as a drive source for reciprocating the carriage 41 along the guide shaft 42. That is, the main scanning unit 40 (carriage 41, guide shaft 42, and carriage motor) causes the carriage 41 (that is, the print head 13) to move in the main scanning direction along the guide shaft 42 (main scanning movement) under the control of the control unit 30.

The supply portion 51 rotatably supports a reel on which the roll paper 5 is wound in a roll shape, and sends the roll paper 5 to a transport path. The storage portion 52 rotatably supports a reel, on which the roll paper 5, is wound, and reels off the roll paper 5, on which printing is completed, from the transport path.

The transport roller 53 is configured with a driving roller that causes the roll paper 5 to move in the sub scanning direction (the Y-axis direction illustrated in FIG. 1) intersecting with the main scanning direction on the platen 55, a driven roller that rotates in accordance with the movement of the roll paper 5, and the like and constitutes the transport path for transporting the roll paper 5 from the supply portion 51 to the storage portion 52 via the printing area (the area where the print head 13 scans the upper surface of the platen 55) of the printing unit 10.

The control unit 30 includes an interface unit (I/F) 31, a CPU 32, a memory 33, a drive control unit 34, and the like, and performs control of the printer 100.

The interface unit 31 is connected to the printer interface unit 119 of the printing control apparatus 110, and performs transmission and reception of data between the printing control apparatus 110 and the printer 100. The printing control apparatus 110 and the printer 100 may be directly connected by a cable and the like, or may be indirectly connected via a network and the like. Further, data transmission and reception may be performed between the printing control apparatus 110 and the printer 100 via wireless communication.

The CPU 32 is an arithmetic processing unit for performing control of the entire printer 100.

The memory 33 is a storage medium that secures an area for storing programs operated by the CPU 32, a working area for operation, and the like, and is configured with a storage element such as a RAM and an EEPROM.

The CPU 32 controls the printing unit 10, and the moving unit 20 via the drive control unit 34 in accordance with the program stored in the memory 33 and the printing data received from the printing control apparatus 110.

The drive control unit 34 controls driving of the printing unit 10 (head unit 11, and ink supply unit 12), and the moving unit 20 (main scanning unit 40, and sub scanning unit 50) based on the control of the CPU 32. The drive control unit 34 includes a movement control signal generation circuit 35, a discharge control signal generation circuit 36, and a drive signal generation circuit 37.

The movement control signal generation circuit 35 is a circuit that generates a signal for controlling the moving unit 20 (main scanning unit 40, and sub scanning unit 50) in accordance with instructions from the CPU 32.

The discharge control signal generation circuit 36 is a circuit that generates a head control signal for selecting the nozzle for discharging ink, selecting the amount to be discharged, controlling the discharge timing, and the like, based on the printing data in accordance with instructions from the CPU 32.

The drive signal generation circuit 37 is a circuit that generates a basic drive signal including a drive signal for driving the piezoelectric element of the printing head 13.

The drive control unit 34 selectively drives the piezoelectric elements corresponding to the nozzles respectively based on the head control signal and the basic drive signal.

Nozzle Rows

Figure 3:
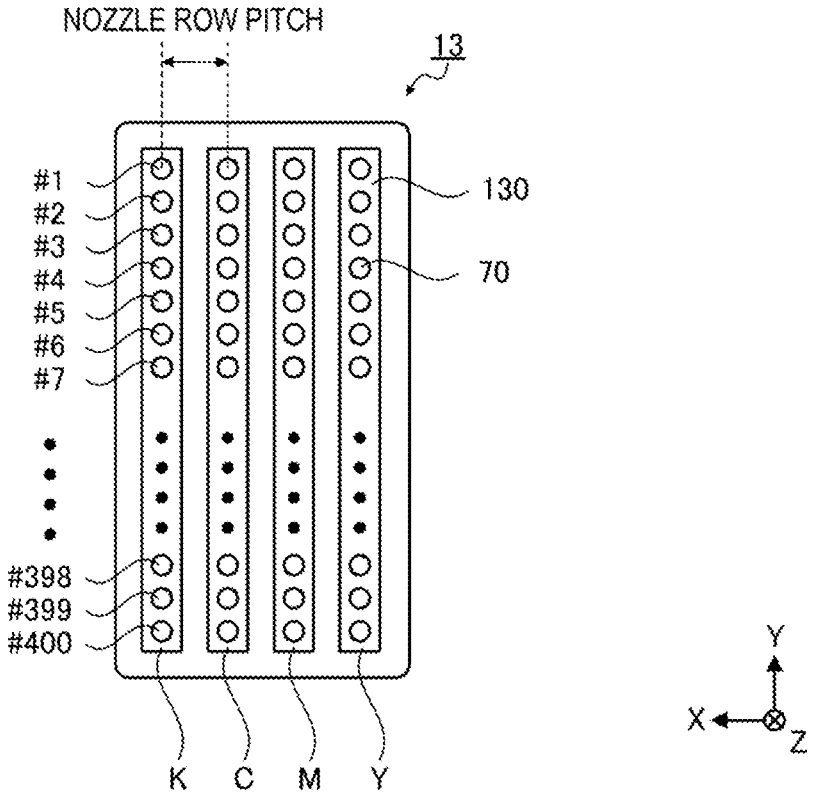
FIG. 3 is a schematic diagram illustrating an example of arrangement of nozzles when viewed from a lower surface of a printing head.

FIG. 3 is a schematic diagram illustrating an example of arrangement of the nozzles when viewed from a lower surface of a printing head 13.

As illustrated in FIG. 3, the printing head 13 includes nozzle rows 130 in which a plurality of nozzles 70 for discharging ink of each color are arranged in lines (In the example illustrated in FIG. 3, a black ink nozzle row K, a cyan ink nozzle row C, a magenta ink nozzle row M, and a yellow ink nozzle row Y each including 400 nozzles 70 of #1 to #400).

The plurality of nozzles 70 of each of the nozzle rows 130 are aligned and lined up at a constant interval (nozzle pitch) along the sub scanning direction (Y-axis direction) respectively. Further, the plurality of nozzle rows 130 are aligned and lined up to be parallel to each other at a constant interval (nozzle row pitch) along a direction (X-axis direction) intersecting with the sub scanning direction. In FIG. 3, the nozzles 70 of each of the nozzle rows 130 are assigned a smaller number as the nozzle 70 arranged on the downstream side (#1 to #400). That is, the nozzle #1 is located on the downstream side of the nozzle #400 in the sub scanning direction. Each of the nozzles 70 is provided with a driving element (piezoelectric element such as a piezo element described above) for driving each of the nozzles 70 to discharge ink droplets.

According to the configuration described above, the control unit 30 forms (prints) a desired image on the roll paper 5 by repeating, with respect to the roll paper 5 supplied to the printing area by the sub scanning unit 50 (supply portion 51, and transport roller 53), a pass movement for discharging (applying) ink droplets from the printing head 13 while moving the carriage 41 that supports the printing head 13 along the guide shaft 42 in the main scanning direction (X-axis direction), and a sub scanning movement for moving the roll paper 5 in the sub scanning direction (+Y-axis direction) intersecting with the main scanning direction by the sub scanning unit 50 (transport roller 53).

Basic Function of Printer Driver in the Related Art

As described above, the printing on the roll paper 5 is started when the printing data has been transmitted from the printing control apparatus 110 to the printer 100. The printing data is data interpreted as data for controlling the drive control unit 34 in the control unit 30 of the printer 100, and is generated by the printer driver.

The printer driver receives the image data (text data, image data, and the like) from the application, converts the image data into printing data in a format that the printer 100 can interpret, and outputs the printing data to the printer 100. When converting the image data from an application into the printing data, the printer driver performs ink color separation processing, BRS correction processing, dot decomposition processing, halftone processing, control data generation processing, and the like.

Hereinafter, each processing will be described.

Figure 4:
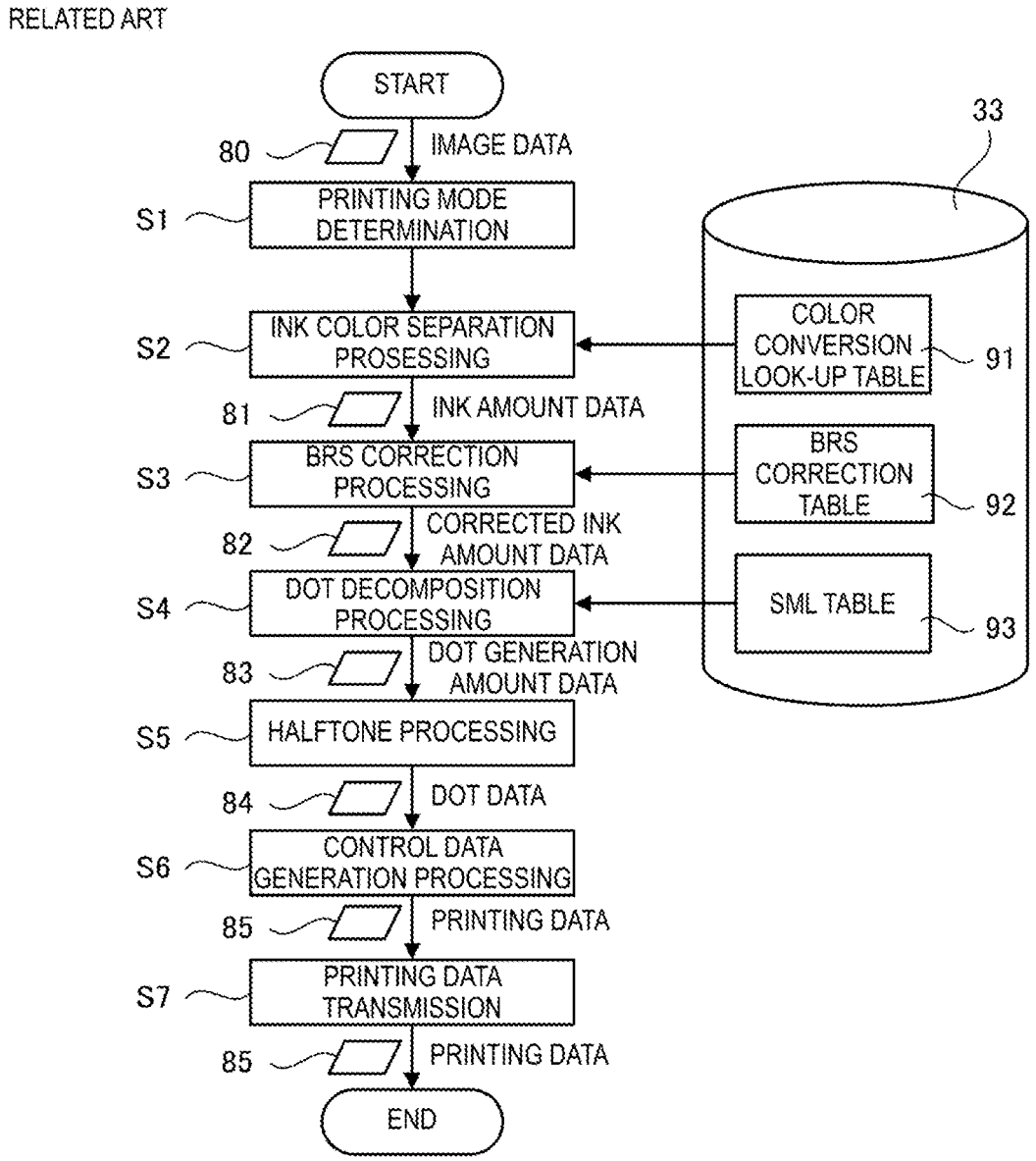
FIG. 4 is a flowchart of printing data generation processing in the related art.

FIG. 4 is a flowchart illustrating a basic flow in the related art of an image processing that generates printing data.

First, the printer driver acquires image data 80 as print target when implementing the printing according to designation of the user and determines a printing mode (step S1).

Here, the printing mode is, for example, in a case where a print specification such as "fine", "high definition", "fast" can be selected by the user when the printing is performed, a mode in which printing corresponding to each selection is executed. A plurality of printing modes, in which the relative movement amounts of the sub scanning movements are different according to the respective selection (that is, the number of the pass movements forming an image is different), correspond to each selection.

Next, the printer driver performs ink color separation processing on the image data 80 (step S2). The ink color separation processing implements processing that separates color data (RGB multi-valued data) of pixels of the image data 80 into ink amounts of four colors of C, Y, M, and K. The ink color separation processing is performed with reference to a color conversion look-up table 91 in which ink amount data of four colors of C, Y, M, and K are associated with RGB multi-valued data (combinations of R, G, and B) which are color data of the RGB color system. The ink amounts of C, Y, M, and K are represented by, for example, 8-bit density tone values (256 tones). Ink amount data 81 of four colors of ink is generated from the image data 80 by ink color separation processing.

Next, the printer driver performs BRS correction processing on the ink amount data 81 (step S3). The BRS correction processing implements processing that adds correction to the ink amount data 81 of each pixel based on the ink discharge characteristic and the arrangement error and the like of the nozzle 70 with reference to a BRS correction table 92.

FIG. 5 illustrates an example of the BRS correction table 92.

In the BRS correction table 92, the ink amount before correction (density tone values) and the ink amount after correction (density tone values) are associated with the nozzles 70. In the BRS correction table 92 illustrated in FIG. 5, the head row is the ink amount before correction (density tone values). Further, in the second and subsequent rows, the nozzle numbers for specifying the nozzles 70 and the corrected density tone values are determined.

The BRS correction table 92 is generated for each individual of the printer 100, and is stored as initial data in the memory 33 (for example, a non-volatile storage medium such as EEPROM) at the time of shipment. When generating the BRS correction table 92, for example, a dedicated pattern including pixels of a plurality of density tone values is printed for four colors of C, M, Y, and K. Then, the printing result of the dedicated pattern is measured by a scanner and the like, and the data corresponding to the input value of the density tone value and the density tone value (output value) of the printing result is acquired. Then, the input value for acquiring a target output value is determined for 256 tones by processing such as linear interpolation.

In the BRS correction processing, first, the printer driver specifies which nozzle 70 the ink is discharged from to perform printing for each pixel of the ink amount data 81. Then, by referring to the data of the corresponding nozzle 70 in the BRS correction table 92, the ink amount (density tone values) before correction is replaced by the ink amount (density tone values) after correction. A corrected ink amount data 82 is determined from the ink amount data 81 by BRS correction processing.

Next, the printer driver performs dot decomposition processing for converting the corrected ink amount data 82 into the ink dot generation amount data based on a SML table 93 (step S4).

Figure 6:
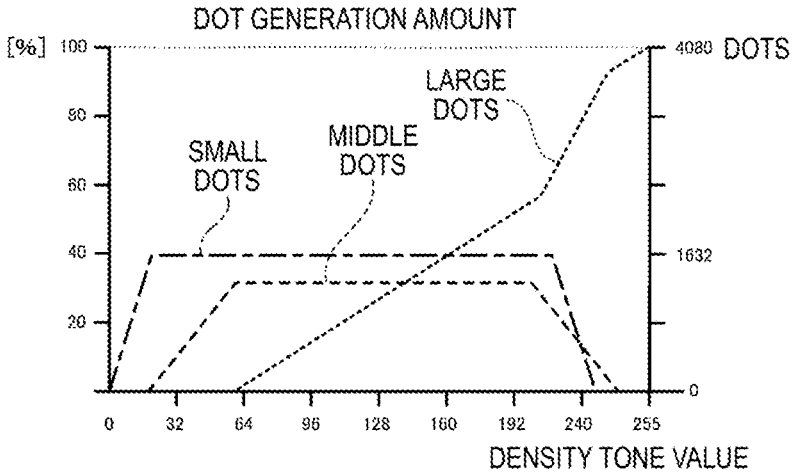
FIG. 6 is an explanatory diagram of SML table.

FIG. 6 is an explanatory diagram of SML table 93. FIG. 6 illustrates an example of SML table 93.

The SML table 93 defines a generation amount of ink dots of three sizes including S (small dots), M (medium dots), and L (large dots) with respect to the density tone values (ink amount). The printer driver performs dot decomposition processing with the SML table 93 to convert the corrected ink amount data 82 into ink dot generation amount data. By the dot decomposition processing, dot generation amount data 83 of ink dots of four sizes including Null (blank dots), S (small dots), M (medium dots), and L (large dots) are acquired.

Next, based on the dot generation amount data 83 of the ink dots acquired by the dot decomposition processing, the printer driver performs halftone processing for determining the presence or absence of dot generation in the pixel for each dot size (step S5). Specifically, in the dot generation amount data 83 of the ink dots acquired, data in the pixel is generated such that dots are formed in a dispersed manner using a dither method, an error diffusion method, and the like. Accordingly, the dot data 84 (binarized data) in which one of the four types of ink dots including the blank dots is specified is generated with respect to the position of the pixel.

Next, the printer driver allocates the dot data 84 generated by the halftone processing to the nozzles 70 of the nozzle rows 130 of C, M, Y, and K, and performs control data generation processing for adding command data necessary for driving control of the printing head 13 (step S6). As the command data, for example, there is sub scanning data related to sub scanning of the roll paper 5, and the like.

By the control data generation processing, the printing data 85 for causing the printer 100 to execute printing is generated, and the generated printing data 85 is transmitted to the printer 100 to start printing (step S7).

However, in the printing data generation processing of the related art, that is, in the printing data generation processing based on the BRS correction processing of the related art, in the case where the printer 100 is a printer capable of printing in a plurality of printing modes, the BRS correction table 92 corresponding to each printing mode has to be prepared. That is, the BRS correction tables 92 corresponding to all printing modes have to be generated in advance and stored in the memory 33. For this purpose, before shipment of the printer 100, it is necessary to generate the BRS correction table 92 by printing a dedicated pattern in each of all printing modes installed as the function of the printer 100 and measuring the printing result (density unevenness) with the scanner. In addition, in a case where a new printing mode is added on the user side after shipment of the printer 100, there is a problem that appropriate or necessary correction cannot be performed since there is no corresponding BRS correction table 92.

In contrast, the printing control apparatus 110 of the present exemplary embodiment includes an "acquisition unit" that acquires discharge characteristic information including the characteristic of discharging ink for each of the nozzles 70, a "correction amount calculation unit" that calculates the correction amount for correcting the ink amount to be discharged onto the printing medium based on the acquired discharge characteristic information of each printing mode in which the relative movements amount of the sub scanning movements are different, and a "printing data generation unit" that generates the printing data for executing printing in accordance with the printing mode based on the calculated correction amount. Details will be described below.

In the present exemplary embodiment, instead of the BRS correction table 92 of the related art, discharge characteristic information including characteristic of discharging ink for each of the nozzles 70 in the memory 33 is stored in advance. This is performed by evaluating the printing head 13 before shipment of the printer 100. That is, in a case of the printer 100 including a plurality of printing modes, it is necessary to store a plurality of BRS correction tables 92 corresponding to the plurality of printing modes in the related art, and in contrast, it is sufficient to store one set of discharge characteristic information (discharge characteristic information for each color ink nozzle row 130). The discharge characteristic information includes information about a variation in the ink discharge amount for each of the nozzles 70, and is acquired by the following procedure.

Figure 7:
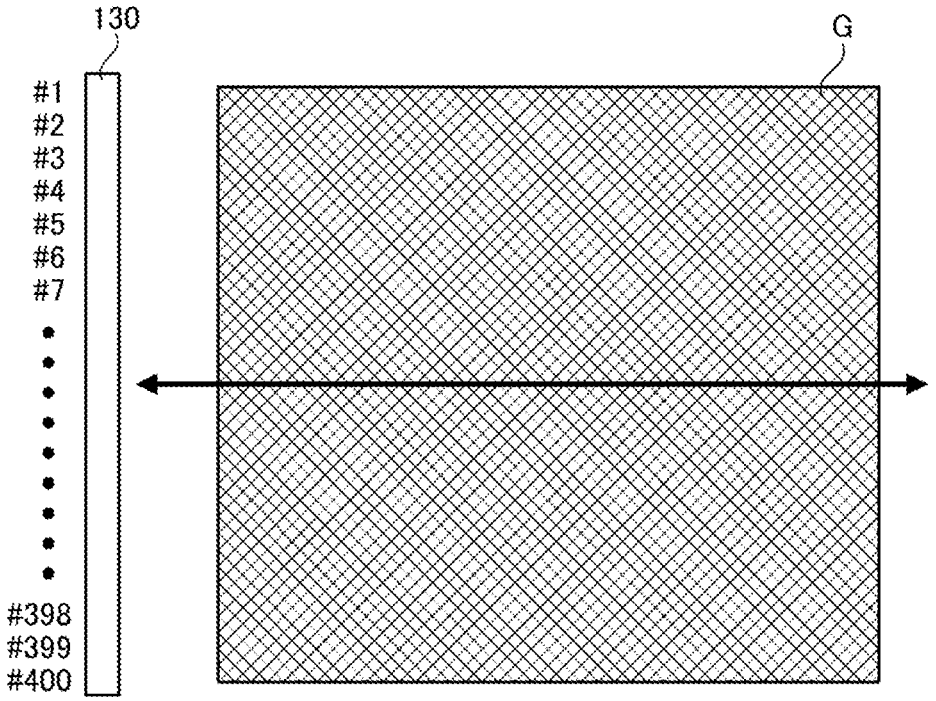
FIG. 7 is an explanatory diagram of a printing pattern for acquiring discharging characteristic information according to Exemplary Embodiment 1.

First, as illustrated in FIG. 7, the printer 100 prints a solid dot pattern G (GK, GC, GM, GY) of a constant tone value for each of the nozzle rows 130 (black ink nozzle row K, cyan ink nozzle row C, magenta ink nozzle row M, and yellow ink nozzle row Y). It is desirable that the solid dot pattern of the constant tone value is a density pattern capable of more significantly confirming the variation in the discharge amount of each of the nozzles 70 included in the nozzle rows 130. For example, in a case where the tone value can be designated by 0 to 255, dots of all dot positions are formed by, for example, dots of a dot size corresponding to the tone value 200 in one pass movement. Alternatively, for example, in a case where the discharge amount variation due to the color of the ink is hard to be confirmed, it may be formed such that the dots are overlappingly made by a plurality of pass movements, instead of one pass movement, without performing a sub scanning movement.

Next, the formed solid dot patterns G (GK, GC, GM, and GY) of the respective colors are, for example, read by a scanner, and the density distributions are acquired as ink discharge amount variation data of the nozzles 70 at corresponding positions.

Figure 8:
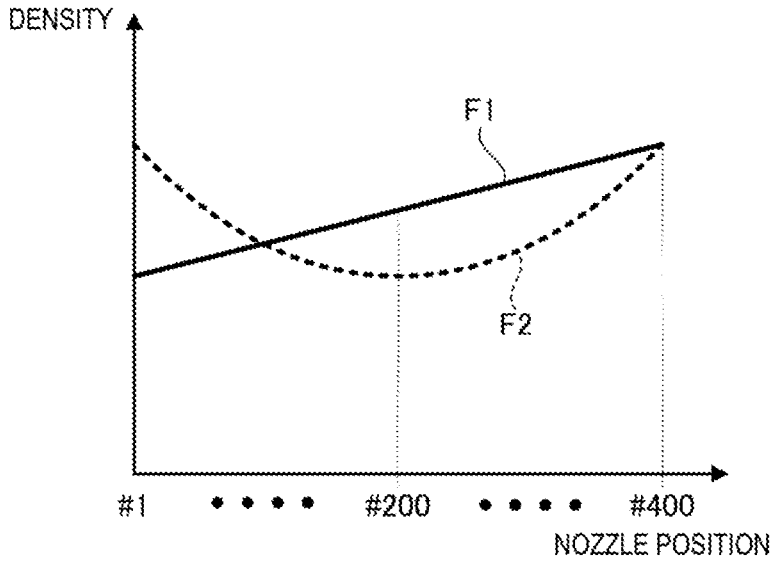
FIG. 8 is a graph illustrating an example of variations of ink discharge amount of the nozzles.

As a result, for example, the ink discharge amount variation data of the nozzle 70 as illustrated in the graph of FIG. 8 is acquired. In the example illustrated in FIG. 8, data F1 in which the density (discharge amount) tends to increase from the nozzle 70 #1 toward the nozzle 70 #400, and data F2 in which the density (discharge amount) tends to decrease at the nozzles 70 toward the center with respect to the nozzle 70 #1 and the nozzle 70 #400 at both ends are illustrated.

The ink discharge amount variation data is the discharge characteristic information in the present exemplary embodiment. That is, the discharge characteristic information includes the characteristic of the discharge amount for discharging the ink for each of the nozzles 70. As the specific discharge characteristic information, for example, the data (±%) of the difference ratio (hereinafter, referred to as difference ratio value) between the average densities of all the nozzles 70 (400 nozzles 70 of #1 to #400) is stored in the memory 33 as the data of the individual nozzles 70.

Note that the data of the difference ratio value as the discharge characteristic information is not limited to the variation data acquired by the measurement in one tone value (tone value 200 in the example described above), and may be a set of a plurality of variation data acquired by measurement with respect to a plurality of tone values. This corresponds to a case where a difference in the degree of variation due to the ink discharge amount (tone) is present, and for example, the data of the difference ratio value may be acquired in each of the five solid dot patterns G including the tone values 50, 100, 150, 200, and 250, and be stored in the memory 33 as a set of five variation data. For example, in a case where the density varies more significantly at a higher density, the correction described below can be performed more appropriately in accordance with the density of an image to be printed.

For generating the printing data, the printing control apparatus 110 reads out the discharge characteristic information stored in the memory 33 and performs correction based on the discharge characteristic information. Therefore, the printing control apparatus 110 includes an "acquisition unit" (not illustrated) that acquires discharge characteristic information stored in the memory 33 as a function unit (a unit for performing processing by software) of the printer driver. Further, the print control apparatus 110 includes a "correction amount calculation unit" that calculates a correction amount for correcting the ink amount to be discharged during printing, and a "printing data generation unit" (not illustrated) that generates printing data for executing printing in accordance with the printing mode based on the calculated correction amount, as function units of the printer driver.

Figure 9:
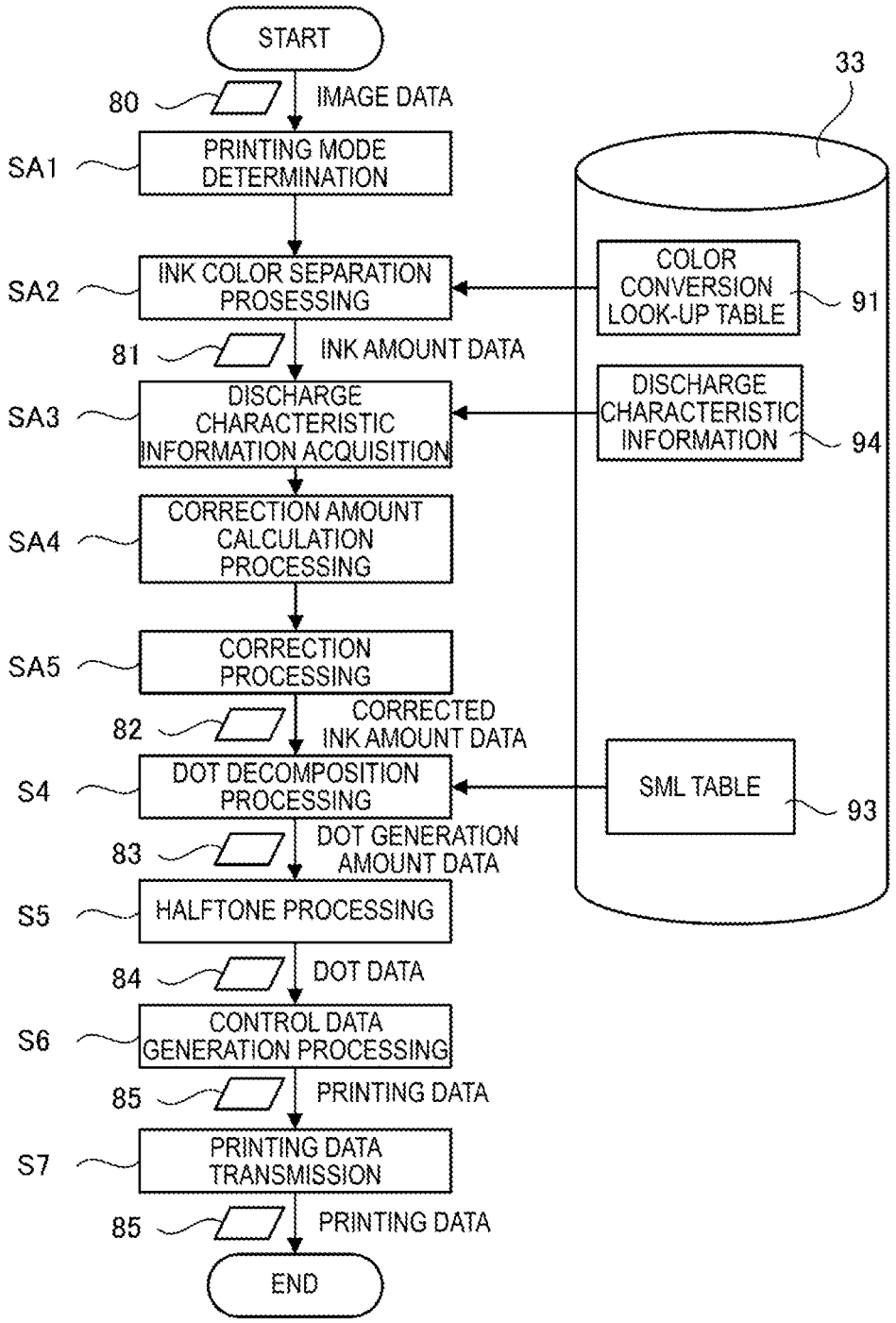
FIG. 9 is a flowchart illustrating a generation flow of the printing data.

FIG. 9 is a flowchart illustrating printing data generation flow according to the present exemplary embodiment. The "acquisition unit", the "correction amount calculation unit", and the "printing data generation unit" will be described in accordance with the flowchart.

First, the printer driver acquires the image data 80 to be printed and determines the printing mode in which the printing is to be performed for printing according to the designation of the user (step SA1).

Next, the printer driver refers to the color conversion look-up table 91 stored in the memory 33, and performs ink color separation processing on the image data 80 (step SA2). The ink amount data 81 of four colors of C, Y, M, and K are associated with RGB multi-valued data (combinations of R, G, and B) which are color data of the RGB color system by ink color separation processing. The ink amounts of C, Y, M, and K are represented by, for example, 8-bit density tone values (256 tones). Ink amount data 81 of four colors of ink is generated from the image data 80 by ink color separation processing.

Next, the printer driver reads out and acquires the discharge characteristic information 94 stored in the memory 33 from the memory 33 as a function of the "acquisition unit" (step SA3).

Next, the printer driver calculates a correction amount for correcting the ink amount to be discharged based on the discharge characteristic information 94 and the determined printing mode as the function of the "correction amount calculation unit" (step SA4). Specifically, the correction amount calculation unit calculates the density distribution of the ink discharged onto the roll paper 5 based on the discharge characteristic information 94 and the printing mode, and calculates the correction amount based on the calculated density distribution.

Figure 10:
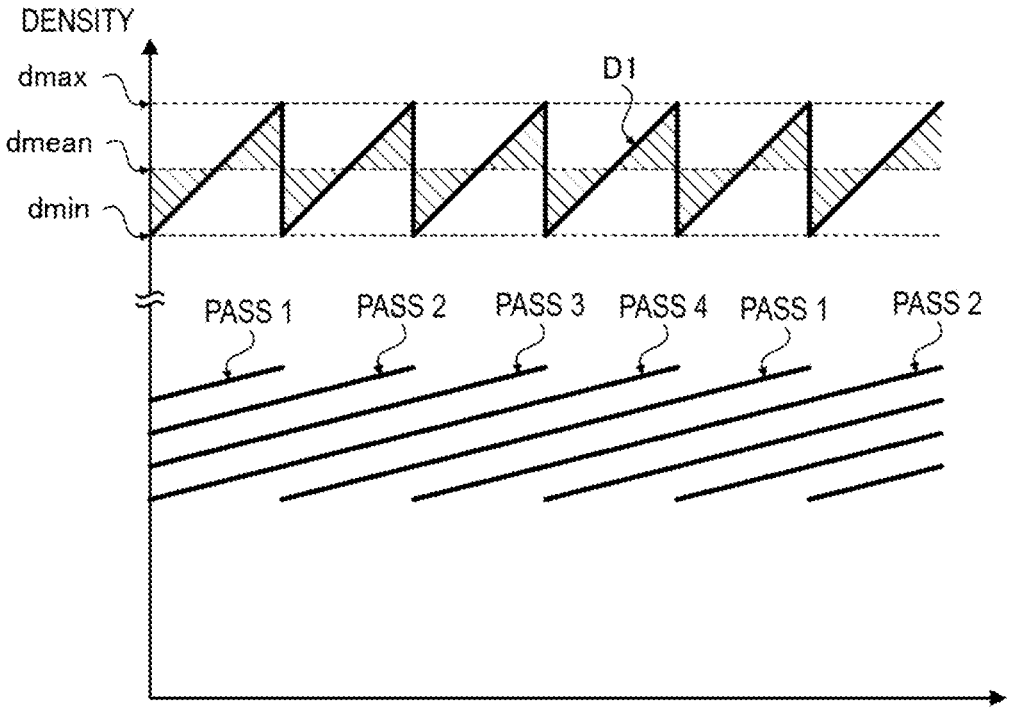
FIG. 10 is a graph for explaining correction amount calculation processing as a function of a correction amount calculation unit.
Figure 11:
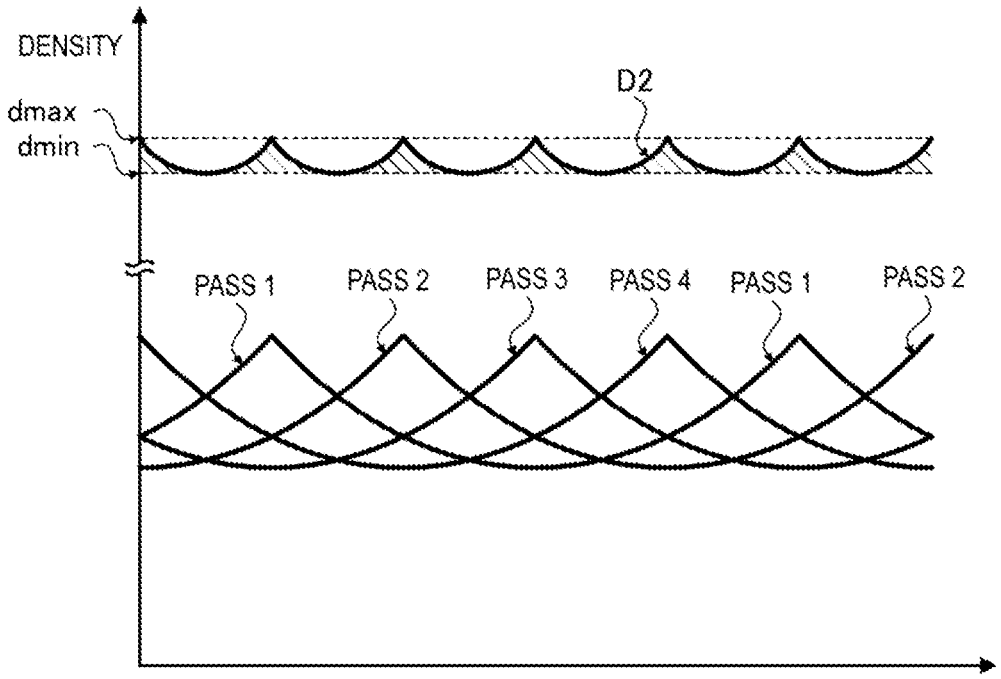
FIG. 11 is a graph for explaining correction amount calculation processing as a function of a correction amount calculation unit.

FIG. 10 and FIG. 11 are graphs for explaining correction amount calculation processing as a function of a "correction amount calculation unit". The horizontal axis (arrow direction) of the graph is the relative movement direction (opposite to the sub scanning direction) of the printing head 13 with respect to the roll paper 5, and the vertical axis is the density of the image formed by the pass movements.

The examples illustrated in FIG. 10 and FIG. 11 are examples of printing modes in which the solid dot pattern G described above is printed in four pass movements.

The lower area of the graph of FIG. 10 illustrates the density of each pass movement (pass 1 to pass 4) of the discharge characteristic corresponding to the data F1 illustrated in FIG. 8, and the upper area of the graph illustrates the density distribution D1 acquired by adding these pass movements (pass 1 to pass 4). The density distribution D1 acquired by adding the densities of the pass movements (pass 1 to pass 4) is the result (estimated) of calculating the density distribution (density unevenness) of the images (the solid dot pattern G) formed by the four pass movements. In the density distribution D1, density distribution (density unevenness) in which density unevenness in each pass movement is added appears. That is, the density distribution D1 illustrates the density distribution of the ink discharged onto the roll paper 5 based on the discharge characteristic information 94 and the printing mode.

The "correction amount calculation unit" calculates the density distribution D1 based on the acquired discharge characteristic information 94 (the ratio of the difference to the average density) and the determined printing mode. Further, the "correction amount calculation unit" calculates an average value dmean of the density distribution D1 from the density distribution D1, and calculates a "correction amount" as a numerical value for filling a difference between the density distribution D1 and the average value dmean (shaded part illustrated in FIG. 10). That is, a correction amount for performing correction is calculated, wherein the correction includes increasing the density tone value to cause the part below the average value dmean to become the average value dmean and reducing the density tone value to cause the part above the average value dmean to become the average value dmean. The correction amount is a ratio value for correcting the density tone of an image to be printed, specifically, for example, matrix data of coefficient data (±%) with respect to the density tone value of the ink amount data 81 for each of the four colors of ink given by the pixel matrix data.

Note that the target of the correction is not limited to the correction in which the average value dmean is the target, and may be, for example, a correction in which the maximum value dmax of the density distribution D1 or the minimum value dmin of the density distribution D1 is the target of correction.

Similarly, the lower area of the graph of FIG. 11 illustrates the density of each pass movement (pass 1 to pass 4) of the discharge characteristic corresponding to the data F2 illustrated in FIG. 8, and the upper area of the graph illustrates the density distribution D2 acquired by adding these movements (pass 1 to pass 4). The density distribution D2 acquired by adding the densities of the pass movements (pass 1 to pass 4) is the result (estimated) of the density distribution (density unevenness) of the images (solid dot pattern G) formed by the four pass movements.

For example, the "correction amount calculation unit" calculates a value to be corrected so that the minimum value dmin of the entire density distribution D2 is the "correction amount".

Next, as illustrated in FIG. 9, the printer driver performs correction based on the "correction amount" of each ink color for each of the ink amount data 81 of the four colors of ink acquired in step SA2 (step SA5), and the corrected ink amount data 82 is generated.

The subsequent processing is the same as the printing data generation processing according to the related art described with reference to FIG. 4. That is, the printing control apparatus 110 includes a "printing data generation unit" that generates printing data 85 for causing printing according to the printing mode based on the calculated correction amount as a function unit (a unit to perform processing by software) of the printer driver.

As a function of the "printing data generation unit", the printer driver performs dot decomposition processing for converting the corrected ink amount data 82 into the ink dot generation amount data based on the SML table 93 (step S4). By the dot decomposition processing, dot generation amount data 83 of ink dots of four kinds of sizes of Null (blank dots), S (small dots), M (medium dots), and L (large dots) are acquired.

Here, the corrected ink amount data 82 is data acquired by performing correction on the ink amount data 81 based on the "correction amount". For example, the density tone value of the region, in which the density of the image is estimated to be low based on the discharge characteristic information 94, is corrected to be high, and thus the dot generation amount data 83 wherein the dot generation amount (dot generation amount data 83 (see FIG. 6) of ink dots of four kinds of sizes including Null (blank dot), S (small dot), M (medium dot), and L (large dot) dot) in the region is highly corrected, is acquired.

Next, based on the dot generation amount data 83 of the ink dots acquired by the dot decomposition processing, the printer driver performs halftone processing for determining the presence or absence of dot generation in the pixel for each dot size (step S5). Accordingly, the dot data 84 (binarized data) in which one of the four types of ink dots including the blank dots is specified is generated with respect to the position of the pixel.

Next, the printer driver allocates the dot data 84 generated by the halftone processing to the nozzles 70 of the nozzle rows 130 of C, M, Y, and K, and performs control data generation processing for adding command data necessary for driving control of the printing head 13 (step S6).

By the control data generation processing, the printing data 85 for causing the printer 100 to execute printing is generated, and the generated printing data 85 is transmitted to the printer 100 to start printing (step S7).

Further, the print control method according to the present exemplary embodiment is a method for controlling the printer 100, as described above, including acquiring the discharge characteristic information 94 including the characteristic of discharging the ink for each of the nozzles 70 (step SA3), calculating the correction amount for correcting the ink amount discharged onto the roll paper 5 based on the discharge characteristic information 94 and each printing mode in which the relative movement amounts of the sub scanning movements are different (step SA4), and generating the printing data 85 for executing printing in accordance with the printing mode based on the correction amount (step SA5, step S4 to step S6).

As described above, the printing apparatus, the printing system, and the printing control method according to the present exemplary embodiment can obtain the following advantages.

The printer 100 controlled by the print control apparatus 110 according to the present exemplary embodiment includes a printing head 13 including a plurality of nozzles 70 configured to discharge ink onto the roll paper 5, a main scanning unit 40 configured to perform a main scanning movement causing the printing head 13 to relatively move with respect to the roll paper 5 in the main scanning direction, and a sub scanning unit 50 configured to perform a sub scanning movement causing the roll paper 5 to relatively move with respect to the printing head 13 in the sub scanning direction intersecting with the main scanning direction. Further, the printer 100 performs printing on the roll paper 5 by repeating the sub scanning movement and the pass movement for discharging ink from the nozzles 70 onto the roll paper 5 during the main scanning movement.

According to the present exemplary embodiment, the printing control apparatus 110 includes an acquisition unit configured to acquire discharge characteristic information including the characteristic of discharging ink for each of the nozzles 70, a correction amount calculation unit configured to calculate a correction amount for correcting amount of the ink discharged onto the roll paper 5 based on the discharge characteristic information for each of printing modes having mutually different relative movement amounts of the sub scanning movements, and printing data generation unit configured to generate printing data for executing printing in accordance with the printing mode based on the calculated correction amount. That is, the printing data for causing the printer 100 to execute printing is generated for each printing mode based on the correction amount calculated based on the discharge characteristic information including the characteristic of discharging the ink for each of the nozzles 70. That is, according to the printing control apparatus 110 of the present exemplary embodiment, even in a case where the printing modes are different, the correction amount corresponding to the printing mode is calculated based on the discharge characteristic information including the characteristic of discharging the ink for each of the nozzles 70, thus, the printer 100 can be caused to perform printing in which the correction suitable for each printing mode has been performed, without performing measurement (measurement of density unevenness) and the like for acquiring the correction amount for each different printing mode.

Further, the discharge characteristic information for calculating the correction amount includes the characteristic of the discharge amount for discharging the ink for each of the nozzles 70, thus, in a case where variation occurs in the discharge amount of ink for each of the nozzles 70, the correction amount that can appropriately correct the variation can be acquired.

Further, the correction amount calculation unit calculates the density distribution of the ink discharged onto the roll paper 5 based on the discharge characteristic information and the printing mode, and calculates the correction amount based on the calculated density distribution.

Based on the printing mode, the relationship of the landing positions (positions of the dots to be formed) of the discharged ink is known, and the ink density of the image printed on the roll paper 5 can be estimated by the positional relationship and the discharge characteristic information including the characteristic of discharging the ink for each of the nozzles 70.

That is, the distribution of the estimated ink density of the image is, that is, the density estimation information of the printed image reflecting the characteristic of discharging the ink for each of the nozzles 70 in each printing mode. Therefore, according to the present exemplary embodiment, an appropriate correction amount can be calculated in accordance with the estimated density of the printed image based on the discharge characteristic information and the printing mode.

Further, according to the printing system of the present exemplary embodiment, even in a case where the printing modes are different, the correction amount corresponding to the printing mode is calculated based on the discharge characteristic information including the characteristic of discharging the ink for each of the nozzles 70, thus, printing can be caused to perform in which correction suitable for each printing mode is performed, without performing measurement (measurement of density unevenness) and the like for acquiring the correction amount for each different printing mode.

Further, the printing control method of the present exemplary embodiment includes acquiring discharge characteristic information including the characteristic of discharging ink for each of the nozzles 70, calculating a correction amount for correcting amount of the ink discharged onto the roll paper 5 based on the discharge characteristic information for each of printing modes having mutually different relative movement amounts of the sub scanning movements, and generating printing data for executing printing in accordance with the printing mode based on the calculated correction amount. That is, the printing data for causing the printer 100 to execute printing is generated for each printing mode based on the correction amount calculated based on the discharge characteristic information including the characteristic of discharging the ink for each of the nozzles 70. That is, according to the printing control method of the present exemplary embodiment, even in a case where the printing modes are different, the correction amount corresponding to the printing mode is calculated based on the discharge characteristic information including the characteristic of discharging the ink for each of the nozzles 70, thus, printing can be caused to perform in which the correction suitable for each printing mode is performed, without performing measurement (measurement of density unevenness) and the like for acquiring the correction amount for each different printing mode.

Note that the method for acquiring the discharge characteristic information is not limited to the method described above of reading the image by the scanner with printing the solid dot pattern G, and acquiring the image as the information of the density distribution. For example, if the measurement is possible, a method may be used in which the size and weight of the ink droplets discharged for each of the nozzles 70 are measured, and the variation distribution is acquired as the characteristic of the discharge amount for discharging the ink for each of the nozzles 70.

Exemplary Embodiment 2

Next, a printing control apparatus, a printing system, and a printing control method according to Exemplary Embodiment 2 will be described. Note that, the same constituents as those in the exemplary embodiment described above are given the same reference signs, and redundant description of these constituents will be omitted.

In Exemplary Embodiment 2, in the printing control apparatus 110, the discharge characteristic information includes characteristic of discharge direction in which ink for each of the nozzles 70 is discharged. The rest is the same as the printing control apparatus, the printing system, and the printing control method for Exemplary Embodiment 1.

Figure 12:
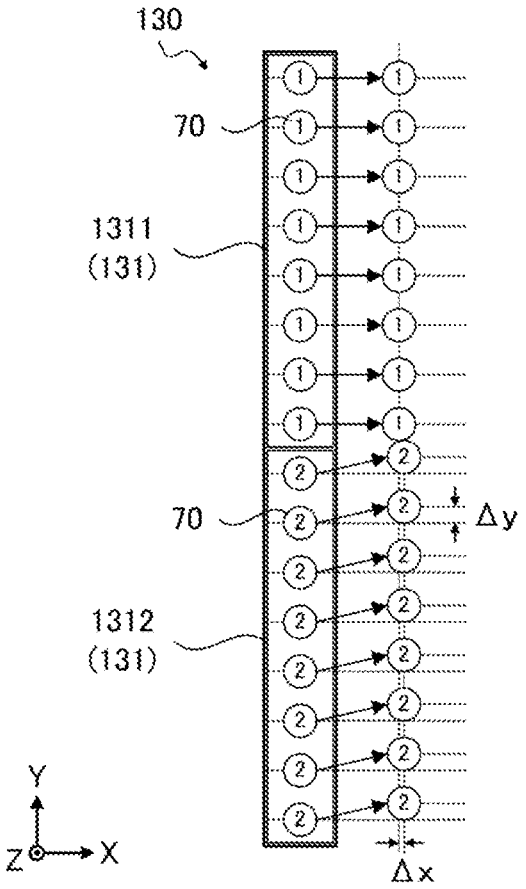
FIG. 12 is an explanatory diagram schematically illustrating an example of deviations of dot formation positions (in an ink discharging direction).

FIG. 12 is an explanatory diagram schematically illustrating an example of a case where a difference (variation) occurs in the characteristic of the discharge direction for discharging the ink from among the ink discharge characteristics among nozzle chips 131 configuring the nozzle row 130, and deviations occur in the dot formation position.

In order to simplify the description, an example will be described in which a nozzle row 130 that discharges ink of the same color is configured by two nozzle chips 131 (nozzle chip 1311 and nozzle chip 1312), and each of the nozzle chips 131 is configured by eight nozzles 70. The nozzle chip 131 is manufactured by, for example, a micro electro mechanical systems (MEMS) manufacturing process applying semiconductor process with a silicon wafer being as a basic material, and the nozzle 70 included in the nozzle chip 131 configures a nozzle group having the same or similar ink discharge characteristics. However, a difference (variation) in the characteristic of the discharge direction in which the ink is discharged may occur depending on the mounting accuracy and the like between the different nozzle chips 131. For example, in a case where eight dot positions formed by one shot with the nozzle chip 1312 are deviated by Ax in the X-axis direction (main scanning direction) and Ay in the Y-axis direction (sub scanning direction) as illustrated by the number 2 in FIG. 12 with respect to the eight dot positions formed by the same shot by the nozzle chip 1311 (positions as illustrated by the number 1 in FIG. 12), the color density unevenness may be visually recognized in the printed image.

Figure 13:
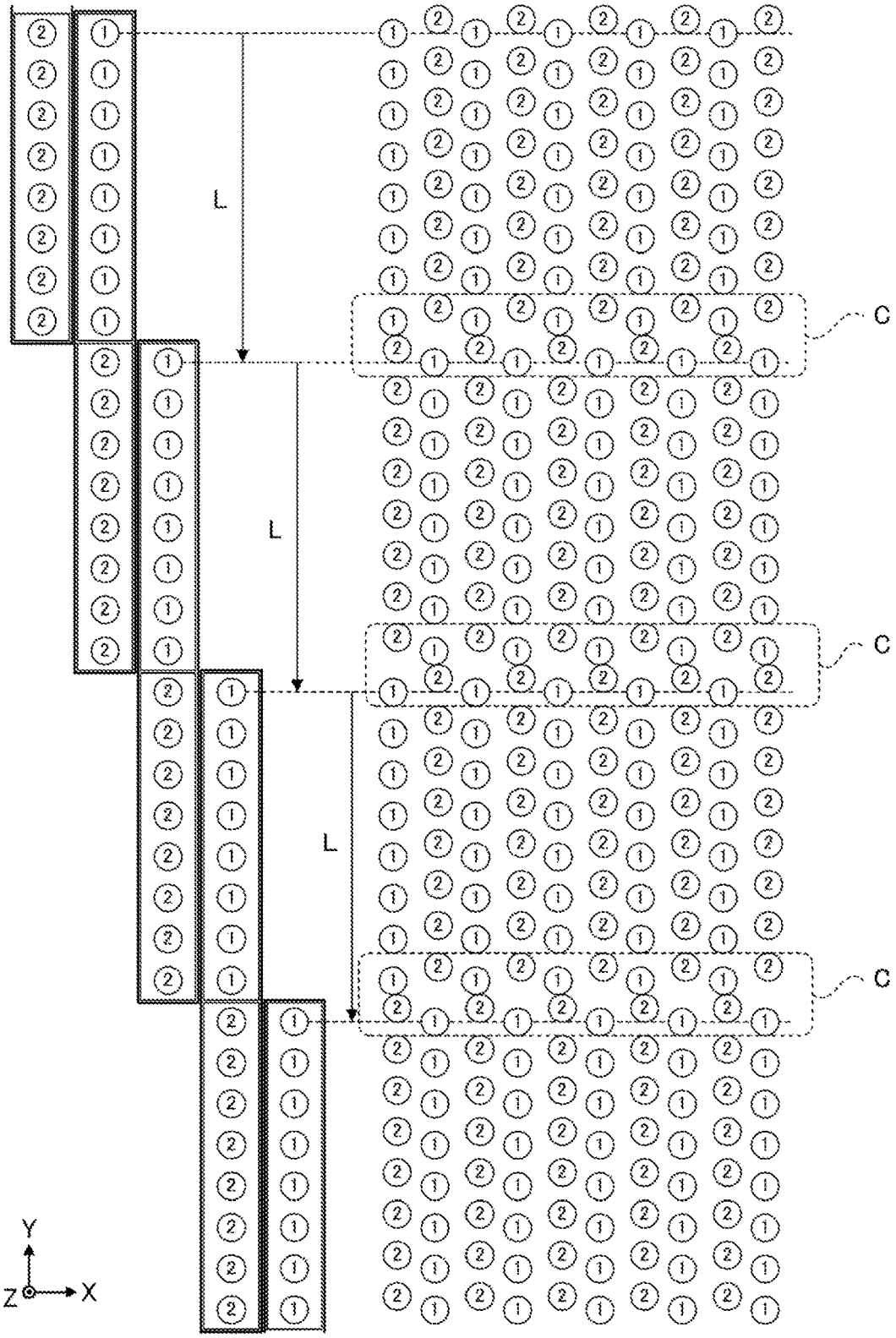
FIG. 13 is a schematic diagram illustrating an example of an image printed in a case where deviations occur in the ink discharging directions.

FIG. 13 is a schematic diagram illustrating an example in which density unevenness is visually recognized in an image printed in such a case.

In the example illustrated in FIG. 13, a feed amount L is set for the length (2L) of the nozzle row 130 and an image is formed by two pass movements. In the first pass movement, printing with half density is performed in the X-axis direction (main scanning direction), and printing is performed to fill gap parts, whose density is reduced by half, in the next pass movement. In the related art, it is known that, in a case where the correction is not performed, the streak unevenness in the X-axis direction is to be visually recognized as in a region C surrounded by the dashed lines illustrated in FIG. 13.

Figure 14:
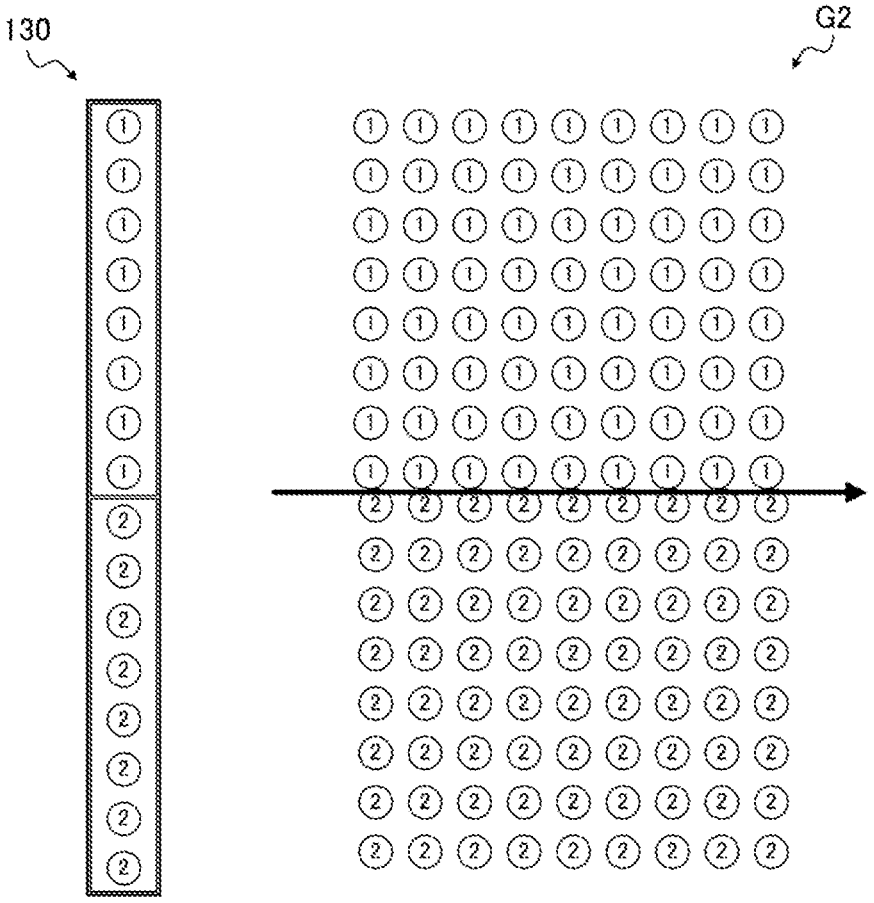
FIG. 14 is an explanatory diagram of the print pattern for acquiring discharging characteristic information according to Exemplary Embodiment 2.

In the present exemplary embodiment, the discharge characteristic information is the characteristic of the discharge direction for discharging ink for each of the nozzles 70. The discharge characteristic information is acquired by, for example, printing the solid dot pattern G2 as illustrated in FIG. 14 and recognizing an image with a scanner, and calculating the centroid position of each dot by image processing.

For example, as illustrated in FIG. 12, in a case where the nozzles 70 included in the same nozzle chip 131 have little variation in the discharge direction and the discharge direction characteristics between different nozzle chips 131 are known as a problem in advance, the discharge direction deviation amount (for example, the deviation amount (Δx, Δy) of the nozzle chip 1312 with respect to the nozzle chip 1311) for each of the nozzle chips 131 with respect to the reference position is set as discharge characteristic information.

As in the case of Exemplary Embodiment 1, the discharge characteristics are previously evaluated and stored in the memory 33 as discharge characteristic information 95 (not illustrated).

The "correction amount calculation unit" acquires the discharge characteristic information 95 via the "acquisition unit", and calculates a correction amount for correcting the ink amount discharged onto the roll paper 5 based on the discharge characteristic information 95 for each printing mode. Specifically, for example, in the case of the example illustrated in FIG. 13, the difference between the ink density in the region C and the ink density outside the region C is calculated as density distribution information, and the correction amount is calculated based on the calculated density distribution. That is, in the case of the example illustrated in FIG. 13, the correction amount for correcting the density tone value of the region C is calculated such that the ink density in the region C increases and becomes uniform as a whole. Alternatively, the correction amount for correcting density tone values outside the region C is calculated such that the ink density outside the region C reduces and becomes uniform as a whole.

As described above, according to the present exemplary embodiment, the discharge characteristic information for calculating the correction amount includes the characteristic of the discharge direction for discharging the ink for each of the nozzles 70, and thus the correction amount for appropriately correcting a variation can be acquired in a case where a variation occurs in the discharge direction of ink for each of the nozzles 70. Further, even in a case where the printing modes are different, the correction amount corresponding to the printing mode is calculated based on the discharge characteristic information including the characteristic of discharging the ink for each of the nozzles 70, and thus, the printer 100 can be caused to perform the printing in which the correction suitable for each printing mode is performed, without measurement (measurement of density unevenness) and the like for acquiring the correction amount for each different printing mode.

Note that, in Exemplary Embodiment 1, the correction in a case where a variation occurs in the discharge amount of the ink for each of the nozzles 70 has been described, and in Exemplary Embodiment 2, the correction in a case where a variation (difference) occurs in the characteristic of the discharge direction of the ink for each of the nozzles 70 has been described, but the factor of the variation in the density of the ink discharged onto the roll paper 5 may be a factor composited by various factors. That is, if various factors that vary the discharge amount and the discharge direction of the ink for each of the nozzles 70 are ascertained in advance, and the discharge characteristic information based on the level of the factor is acquired, even if it is a single factor or a composite factor, as long as the configuration allows the ink density distribution of the image for printing to be estimated by reflecting the respective characteristics on the basis of the desired printing mode, by correcting the ink amount data 81 according to the estimation result and acquiring the corrected data as the corrected ink amount data 82, the printer 100 can be caused to perform printing in which the correction suitable for each printing mode is performed.

Factors that vary the discharge amount and the discharge direction of the ink, for example, may include a difference (variation) caused by the ink discharge frequency (discharge frequency), a difference (variation) caused by the ink discharge position (the position of the printing head 13 in the main scanning direction), and the like.

This application claims priority under 35 U.S.C. § 119 to Japanese Patent Application No. 2017-241518, filed Dec. 18 2017. The entire disclosure of Japanese Patent Application No. 2017-241518 is hereby incorporated herein by reference.

What is claimed is:

1. A printing control apparatus configured to control a printing apparatus including a printing head including a plurality of nozzles configured to discharge ink onto a printing medium, a main scanning unit configured to perform a main scanning movement causing the printing head to relatively move with respect to the printing medium in a main scanning direction, and a sub scanning unit configured to perform a sub scanning movement causing the printing medium to relatively move with respect to the printing head in a sub scanning direction intersecting with the main scanning direction, the printing apparatus being configured to perform printing on the printing medium by repeating the sub scanning movement and a pass movement for discharging the ink from the nozzles onto the printing medium during the main scanning movement, the printing control apparatus comprising:

an acquisition unit configured to acquire discharge characteristic information including a characteristic of discharging the ink for each of the nozzles;

a correction amount calculation unit configured to calculate a correction amount for correcting an amount of the ink discharged onto the printing medium based on the discharge characteristic information for each of printing modes having mutually different relative movement amounts of the sub scanning movements; and a printing data generation unit configured to generate printing data for executing printing in accordance with the printing mode based on the correction amount.

2. The printing control apparatus according to claim 1, wherein the discharge characteristic information includes a characteristic of a discharge amount for discharging the ink for each of the nozzles.

3. The printing control apparatus according to claim 1, wherein the discharge characteristic information includes a characteristic of a discharge direction for discharging the ink for each of the nozzles.

4. The printing control apparatus according to claim 1, wherein the correction amount calculation unit calculates a density distribution of the ink discharged onto the printing medium based on the discharge characteristic information and the printing mode, and calculates the correction amount based on the calculated density distribution.

5. A printing system, comprising:

the printing control apparatus according to claim 1, and a printing apparatus including a printing head including a plurality of nozzles configured to discharge ink onto a printing medium, a main scanning unit configured to perform a main scanning movement causing the printing head to relatively move with respect to the printing medium in a main scanning direction, and a sub scanning unit configured to perform a sub scanning movement causing the printing medium to relatively move with respect to the printing head in a sub scanning direction intersecting with the main scanning direction, and the printing apparatus being configured to perform printing on the printing medium by repeating the sub scanning movement and a pass movement for discharging the ink from the nozzles onto the printing medium during the main scanning movement.

6. A printing control method for controlling a printing apparatus including a printing head including a plurality of nozzles configured to discharge ink onto a printing medium, a main scanning unit configured to perform a main scanning movement causing the printing head to relatively move with respect to the printing medium in a main scanning direction, and a sub scanning unit configured to perform a sub scanning movement causing the printing medium to relatively move with respect to the printing head in a sub scanning direction intersecting with the main scanning direction, the printing apparatus being configured to perform printing on the printing medium by repeating the sub scanning movement and a pass movement for discharging the ink from the nozzles onto the printing medium during the main scanning movement, the printing control method comprising:

acquiring discharge characteristic information including a characteristic of discharging the ink for each of the nozzles;

calculating a correction amount for correcting an amount of the ink discharged onto the printing medium based on the discharge characteristic information for each of printing modes having mutually different relative movement amounts of the sub scanning movements; and generating printing data for executing printing in accordance with the printing mode based on the correction amount.

* * * * *